US005327801A

United States Patent [19]

Andreasen et al.

[11] Patent Number: 5,327,801

[45] Date of Patent: Jul. 12, 1994

[54] DUCT STRAP TOOL

[76] Inventors: Jon R. Andreasen, 12210 Cange St., Anchorage, Ak. 99516; Anthony M. Patsfield, P.O. Box 35, Rescue, Calif. 95672

[21] Appl. No.: 24,181

[22] Filed: Feb. 26, 1993

[51] Int. Cl.[5] ..... B25B 13/06

[52] U.S. Cl. ..... 81/125; 81/177.2

[58] Field of Search ..... 81/125, 177.2, 180.1

*Primary Examiner*—D. S. Meislin

*Attorney, Agent, or Firm*—John P. O'Banion

[57] ABSTRACT

An apparatus (10) for attaching a duct strap material (14) to an overhead support structure by means of a screw-type fastener (26) is disclosed. The apparatus (10), which is coupled to a hollow extension pole (12) and driven by a source of rotary power (24), includes a body portion (20) with a socket (30) for supporting and driving the screw-type fastener (24). Socket (30) is positioned at one end of a fastener support (46) which is located within a cavity (34) within body portion (20). Fastener support (46) includes an upper driver member (48) which is releasably coupled to a lower support member (50). Lower support member (50) is in turn coupled to body portion (20). Upper driver member (48) can be separated from lower support member (50) by inserting a screwdriver or similar instrument into a passage (64). A recessed channel (18) extends between the ends of the body portion (20) to form a guide for the strap material (14) which is inserted in a chamber (16) within extension pole (12) prior to installation.

20 Claims, 3 Drawing Sheets

DUCT STRAP TOOL

BACKGROUND OF THE INVENTION

1. Field of the Invention

This invention pertains generally to tools, and more particularly to an apparatus for installing strap material used to suspend heating, ventilation and air conditioning duct.

2. Description of the Background Art

Heating, ventilation and air conditioning systems and equipment are connected to air registers and returns throughout residential and commercial buildings. Connection is typically made using rigid or flexible ducts. In many installations, the duct work is installed in an attic or other overhead location and the length of runs are typically such that the duct work is not self-supporting. Therefore the duct work is suspended from an overhead support structure. Attachment is commonly made by means of a flexible metallic strap material which is wrapped around the duct and secured to an overhead support structure.

During installation of the strap material, it is necessary for the installer to use a ladder to reach the location at which the strap material is to be attached to the overhead support structure. A hole is generally punched into one end of the strap material, a screw-type fastener or lag is inserted through the hole, and the fastener is screwed into the support structure either manually or assisted by a rotary power driver. The installer then moves the ladder to another location and repeats the process until the strap material is installed at a sufficient number of locations to provide the desired support for the duct work.

As can be seen, therefore, the installer must repeatedly go up and down the ladder and move the ladder to different locations. The installer must carry strap material, fasteners, and hand tools up and down the ladder. This approach requires considerable time and effort for installation of the strap material. Furthermore when a ladder is used, particularly where the overhead support structure is a considerable distance above the floor, there is a high risk of bodily injury to the installer.

Therefore, there is a need for an apparatus which would allow the installer to install the strap material from the floor and eliminate the need for using a ladder. The present invention satisfies that, as well as other needs as described herein.

SUMMARY OF THE INVENTION

The present invention pertains to an apparatus which can be used to attach duct strap to an overhead support structure by means of a screw-type fastener. The apparatus is attached to an extension pole or the like so that the duct strap can be installed while standing at the ground level.

By way of example and not of limitation, the apparatus of the present invention generally comprises a body portion which is elongated and semi-cylindrical in shape. A generally rectangular channel extends between each end of a generally cylindrical body to form a recessed guide for the strap material, hence the semi-cylindrical overall shape.

Extending from one end of the body toward the other end is a cavity which is coaxially aligned with the central longitudinal axis of the body. Located within the cavity, and coupled to the body, is a support for a screw-type fastener. Preferably the fastener support is a two-piece structure having an upper driver member and a lower support member. The upper driver member typically has a hex-shaped socket portion at one end for receiving the head of the screw-type fastener, and a hex-shaped shaft with an annular groove at the other end. The lower support member is of a similar configuration but contains, within its socket portion, an annular spring coupling mechanism which engages the annular groove in the shaft of the upper driver member for a releasable snap fit. Therefore, the upper driver member can be detached from the lower support member for replacement, which is particularly advantageous when different size screw-type fasteners must be used. A passage extends from the channel to the cavity so that a screwdriver or the like can be inserted to separate the upper driver member from the lower support member.

The body is preferably coupled to a hollow telescoping extension pole or the like. One end of the pole has a larger diameter than the body, so that the body and guide channel will project into the pole when coupled. When the pole is extended, a length of strap material is inserted into the hollow chamber of the pole and aligned with the guide channel. Ribs are provided on each side of the guide channel to prevent the strap material from sliding laterally and, therefore, allow the strap material to be smoothly fed from the pole during overhead installation. Attached to the other end of the pole is a hex-shaped shank or the like for coupling the pole to a source of rotary power such as an electric drill.

An object of the invention is to provide for attaching duct strap material to an overhead support structure.

Another object of the invention is to provide for installing duct strap material from the ground level.

Another object of the invention is to eliminate the need to use a ladder when installing duct strap material.

Another object of the invention is to reduce the time and expense of installing duct strap material.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes the present invention is embodied in the apparatus which is generally shown in FIG. 1 through FIG. 5. It will be appreciated that the apparatus may vary as to configuration and as to details of the parts without departing from the basic concepts as disclosed herein.

Figure 1:
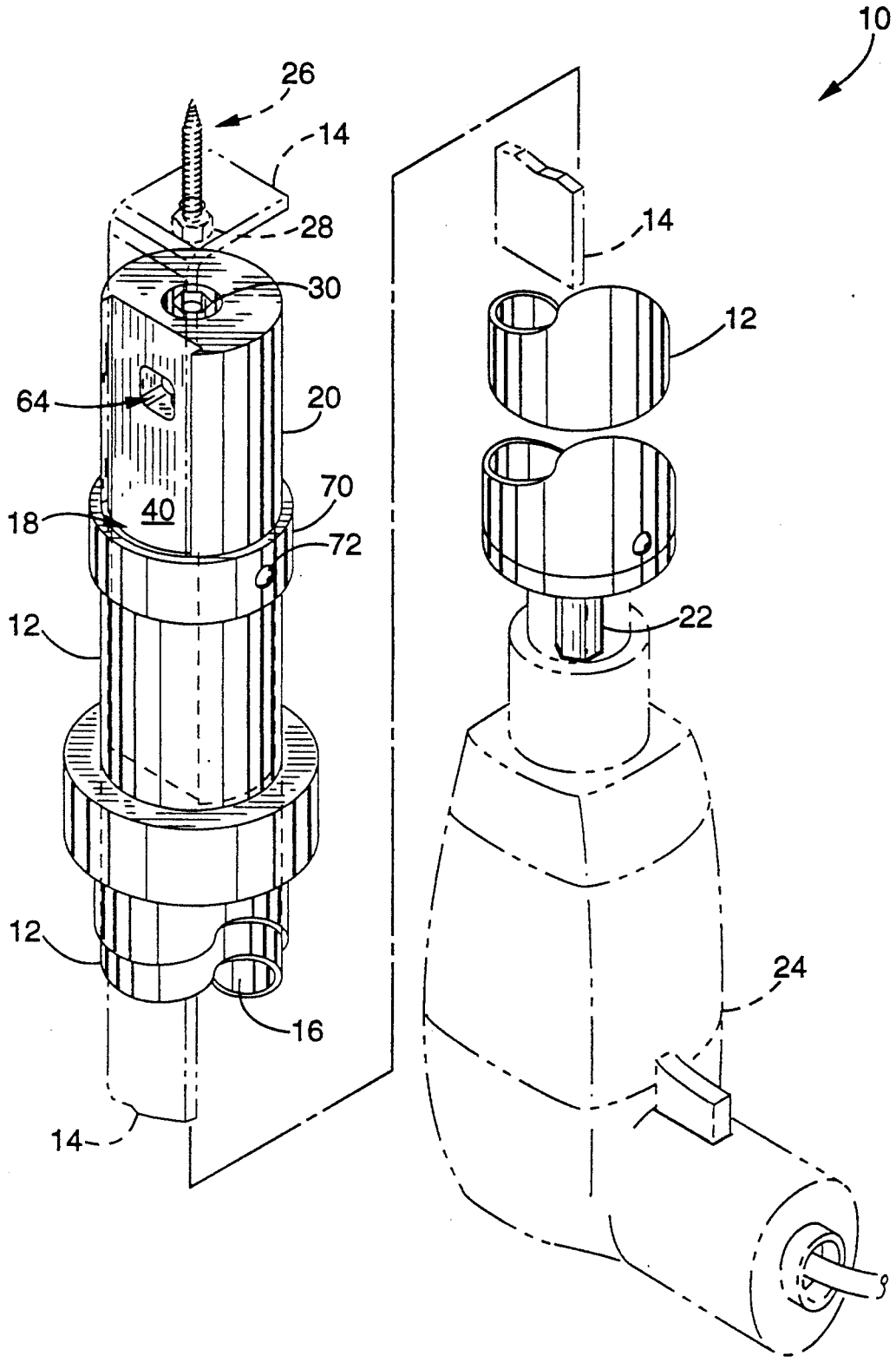
FIG. 1 is perspective view showing the apparatus of the present invention coupled to an extension pole, and in its context of use with a screw-type fastener, strap material, and rotary power drive shown in phantom.

Referring to FIG. 1, the present invention generally comprises a duct strap tool 10 which is typically coupled to the distal end of a hollow, telescoping, extension pole 12 or the like by any conventional means. When extension pole 12 is set to the desired length, a length of strap material 14 can be inserted into the hollow chamber 16 of extension pole 12 and aligned with a guide channel 18 which is recessed in body 20 of duct strap tool 10. Attached to proximal end of extension pole 12 is a hex-shaped shank 22 or the like for coupling extension pole 12 to a source of rotary power such as an electric drill 24. In operation, the user drills or punches a hole (not shown) into strap material 14 and inserts the threaded portion of a screw-type fastener 26 or the like through the hole. Typically the screw-type fastener 26 will feature a hex-shaped head 28 which will be placed in a hex-shaped socket 30 of corresponding size. In this way, the screw-type fastener 26 can be supported by duct strap tool 10 and rotated by drill 24 or other source of rotary power. It will be appreciated that, while the strap material 14 need not be inserted into the hollow chamber 16 during installation, failure to do so may result in the strap material 14 being wound around the extension pole 12. It should also be noted that, not only can the apparatus be used to install a strap material 14, it can be used to install an L-shaped clip or bracket of the type commonly used in the industry.

Figure 2:
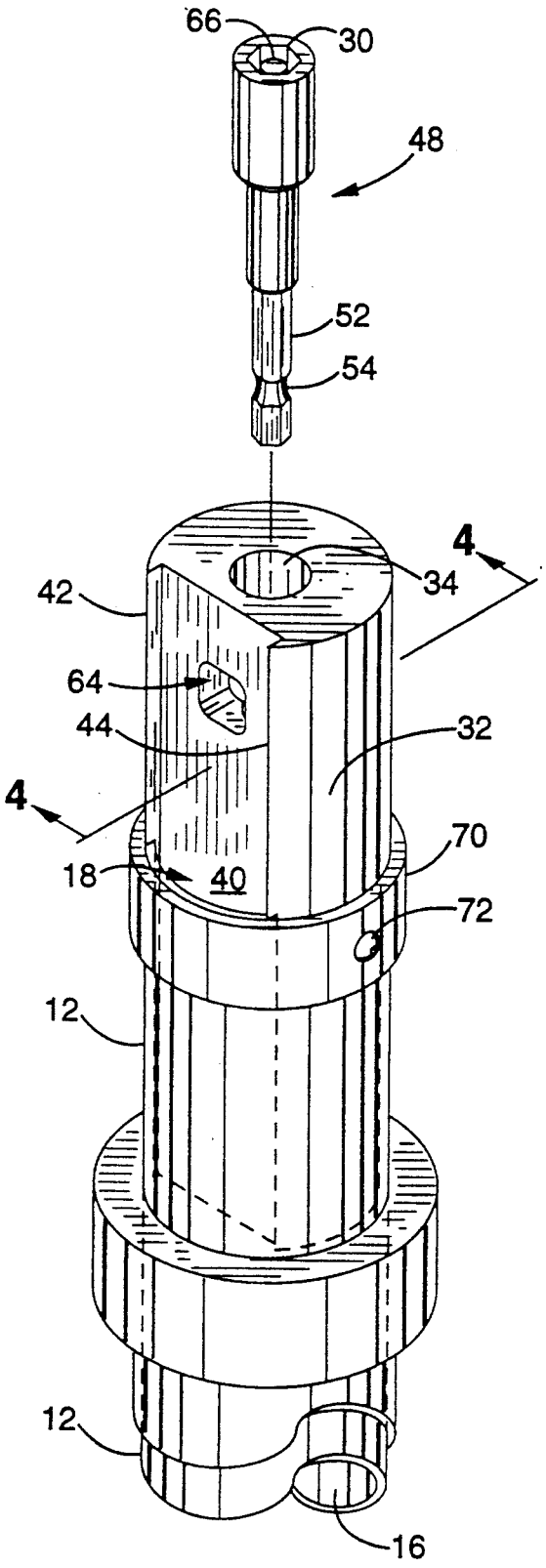
FIG. 2 is a perspective view showing the apparatus coupled to an extension pole, and the upper drive member exploded from the apparatus.
Figure 3:
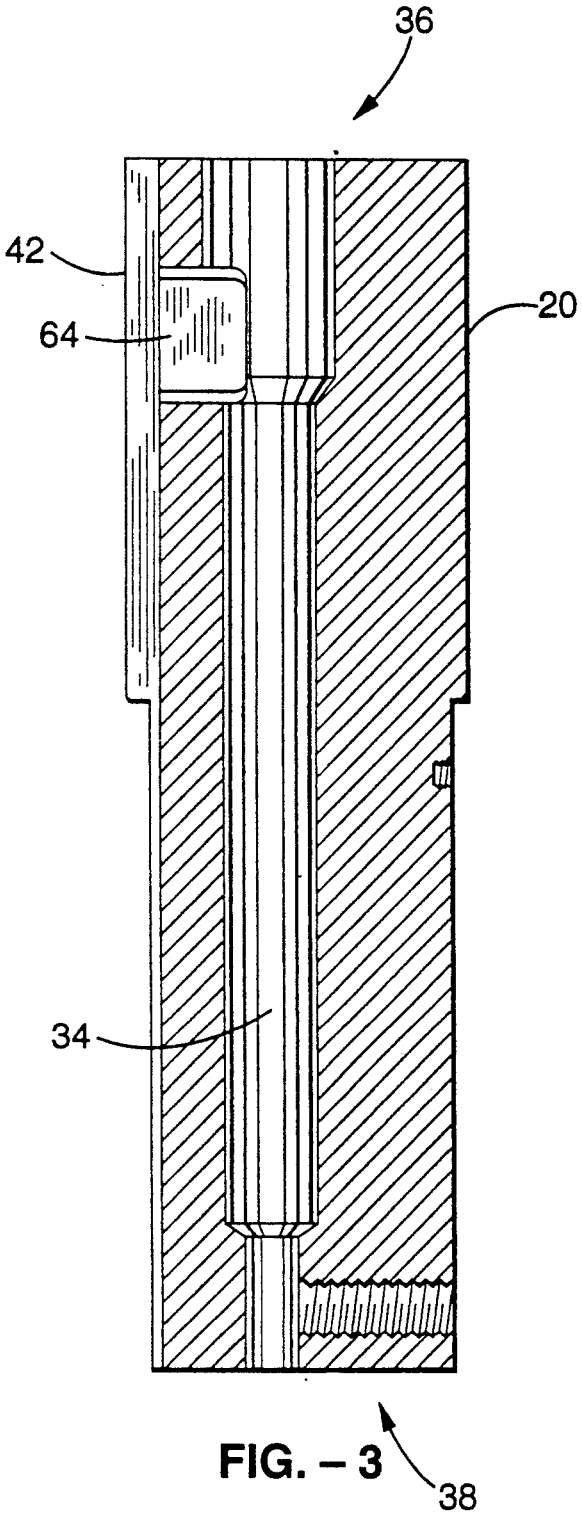
FIG. 3 is a cross-section of the body portion of the apparatus taken through line 4—4.

Referring to FIG. 2 and FIG. 3, body 20 is preferably elongated and semi-cylindrical in shape, thereby having an arcuate outer surface 32. An opening or cavity 34 extends from the distal end 36 of body 20 toward the proximal end 38, and is coaxially aligned with the central longitudinal axis of body 20. Guide channel 18 is preferably a generally rectangular-shaped channel longitudinally aligned with body 20, and has a generally planar inner surface 40. The width of guide channel 18 would correspond to that of the strap material 14, which typically ranges from one inch (2.54 cm) to one and one-half inches (3.18 cm). Of course, other widths of strap material 14 could be easily accommodated. Note also that guide channel 18 extends from outer surface 32 toward cavity 34 to form a recess in body 20. Ribs 42, 44 are provided on each side of guide channel 18 to prevent the strap material 14 from sliding laterally. Ribs 42, 44 are also tapered toward proximal end 38. In this way, the proximal end 38 of body 20 can extend into chamber 16 at the distal end of extension pole 12, thereby permitting guide channel 18 to communicate with chamber 16 and, if desired, permitting ribs 42, 44 to also extend into chamber 16. Where strap material 14 is sufficiently wide, ribs 42, 44 can be eliminated if desired since lateral movement of strap material 14 will be constrained by extension pole 12 as it is drawn out of hollow chamber 16. In that embodiment, guide channel 18 would simply comprise the unbounded planar inner surface 40 which is recessed into body 20.

Figure 4:
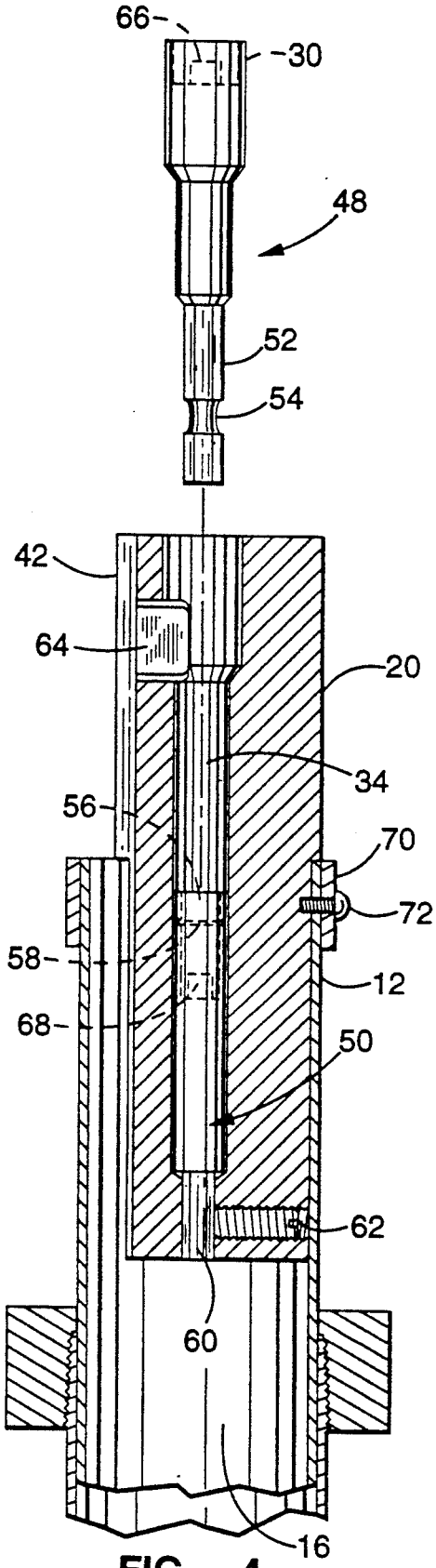
FIG. 4 is a side elevation view of the apparatus showing the upper driver member exploded from the body, the body in cross-section taken through line 4—4, and the lower support member positioned in a cavity in the body.
Figure 5:
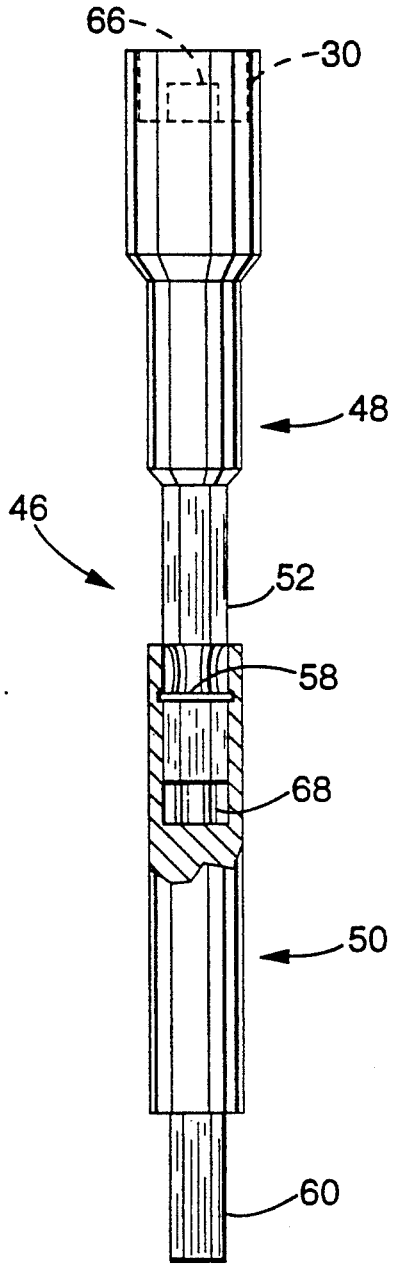
FIG. 5 is a side elevation view of the fastener support portion of the apparatus with the upper driver member coupled to the lower support member.

Referring now to FIG. 4 and FIG. 5, disposed within cavity 34 is a fastener support 46. Preferably fastener support 46 is a two-piece structure having an upper driver member 48 and a lower support member 50. Hex-shaped socket portion 30 for receiving head 28 of the screw-type fastener 26 is located at the distal end of upper driver member 48, while a hex-shaped shank 52 with an annular groove 54 is located at the proximal end. Lower support member 50 is of a similar configuration and includes a hex-shaped socket portion 56. Disposed within hex-shaped socket portion 56 is an annular spring 58 which engages annular groove 54 in upper driver member 48 for a releasable snap fit. Note also, that the resulting releasable spring coupling mechanism could be alternatively established by a conventional ball-type coupling mechanism or the like. Lower support member 50 also includes a shank 60 which serves to couple lower support member 50 to body 20. A set screw 62 or the like extending between the outer surface 32 of body 20 into cavity 34 is used to engage shank 60 and secure it in place.

It can be seen, therefore, that upper driver member 48 can be detached from lower support member 50. Serving as a release port, a passage 64 extends between inner surface 40 of guide channel 18 and cavity 34 so that a screwdriver or the like can be inserted to separate upper driver member 48 from the lower support member 50. Alternatively, fastener support 46 could be made as a one-piece non-detachable structure. In addition, if desired, a magnet 66 or the like can be included in socket portion 30 to prevent screw-type fastener 14 from falling out. Also, a magnet 68 could be included within hex-shaped socket portion 56 to strengthen the coupling force between upper driver member 48 and lower support member 50.

Referring to FIG. 1 and FIG. 2, the outer diameter of body 20 near proximal end 38 is less than the inner diameter of the distal end of extension pole 12. In this way, body 20 can be coupled to extension pole 12 by insertion into hollow chamber 16. A collar 70, made from a material such as steel or the like, surrounds a portion of extension pole 12 at the point of transition between extension pole 12 and body 20 and, therefore, is generally aligned with the distal end of extension pole 12. Collar 70 and body 20 are secured to extension pole 12 by means of a screw 72 which extends through collar 70, through the wall of extension rod 12 and into body 20. While body 20 could be secured to extension rod 12 without the use of collar, the preferred embodiment includes collar 70. The benefit of this configuration stems from most extension poles being made of a soft material such as aluminum or the like. When the strap material 14 is secured in place to the overhead support structure, it is often necessary to twist body 20 until strap material 14 is in a desired orientation for hanging the duct work. In doing so, the edge of strap material 14 can cut into the end of extension pole 12 causing undue wear. Therefore, collar 70 serves to guard against premature wear or damage to the distal end of extension pole 12 where it is coupled to body 20.

Accordingly, it will be seen that this invention provides a safe and efficient tool for installing duct strap to overhead support structures. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. An apparatus for installing a strap material for supporting heating, ventilation and air conditioning duct and the like, comprising:

(a) fastener support means for receiving and supporting a screw-type fastener;

(b) a body, said body having first and second ends and an outer surface, said body including a cavity extending coaxially from said first end of said body toward said second end of said body, said fastener support means disposed within said cavity and coupled to said body; and (c) strap guide means for guiding a strap material, said strap guide means extending between said first and second ends of said body, said strap guide means recessed from said outer surface of said body toward said cavity.

2. An apparatus as recited in claim 1, wherein said fastener support means comprises:

(a) a lower support member, said lower support member coupled to said body;

(b) an upper support member, said upper support member coupled to said lower support member, said upper support member including a receptacle for receiving said screw-type fastener.

3. An apparatus as recited in claim 2, wherein said upper support member is releasably coupled to said lower support member.

4. An apparatus as recited in claim 3, further comprising a passage extending between said strap guide means and said cavity, whereby said upper support member can be separated from said lower support member by inserting a screwdriver or the like into said passage.

5. An apparatus as recited in claim 1, wherein said strap guide means comprises a generally rectangular channel longitudinally aligned with said body, said channel having a generally planar inner surface.

6. An apparatus as recited in claim 1, further comprising an extension pole, said extension pole having first and second ends, said first end of said extension pole coupled to said second end of said body.

7. An apparatus as recited in claim 6, said extension pole including a hollow chamber, said second end of said body extending into said hollow chamber, whereby said strap material can be inserted into said hollow chamber and fed from said hollow chamber along said strap guide means during installation of said strap material.

8. An apparatus as recited in claim 6, further comprising a collar, said collar coupled to said extension pole, said collar generally aligned with said first end of said extension pole.

9. An apparatus as recited in claim 6, further comprising power coupling means for coupling said second end of said extension pole to a source of rotary power.

10. A duct strap hanging tool, comprising:

(a) a body, said body having first and second ends and an outer surface, said body including an opening extending coaxially from said first end of said body toward said second end of said body;

(b) fastener support means for receiving and supporting a screw-type fastener, said fastener support means disposed within said opening and coupled to said body; and (c) a generally rectangular channel extending between said first and second ends of said body, said channel being recessed from said outer surface toward said opening, said channel having a generally planar inner surface.

11. An apparatus as recited in claim 10, wherein said fastener support means comprises:

(a) a lower support member, said lower support member coupled to said body;

(b) an upper support member, said upper support member coupled to said lower support member, said upper support member including a receptacle for receiving said screw-type fastener.

12. An apparatus as recited in claim 11, wherein said upper support member is releasably coupled to said lower support member.

13. An apparatus as recited in claim 12, further comprising a passage extending between said planar inner surface of said channel and said opening, whereby said upper support member can be separated from said lower support member by inserting a screwdriver or the like in said passage.

14. An apparatus as recited in claim 13, further comprising an extension pole, said extension pole having first and second ends, said first end of said extension pole coupled to said second end of said body.

15. An apparatus as recited in claim 14, said extension pole including a hollow chamber, said second end of said body extending into said hollow chamber, whereby said strap material can be inserted into said hollow chamber and fed from said hollow chamber along said strap guide means during installation of said strap material.

16. An apparatus as recited in claim 15, further comprising a collar, said collar coupled to said extension pole, said collar generally aligned with said first end of said extension pole.

17. An apparatus as recited in claim 16, further comprising power coupling means for coupling said second end of said extension pole to a source of rotary power.

18. An apparatus for installing hanger strap for ventilation duct and the like, comprising:

(a) a generally cylindrical body, said body having first and second ends, said body having an arcuate outer surface;

(b) a cavity, said cavity coaxially disposed in said body, said cavity extending from said first end of said body toward said second end of said body;

(c) a receptacle, said receptacle disposed in said cavity, said receptacle having first and second ends, said first end of said receptacle configured and structured for receiving a screw-type fastener or the like, said second end of said receptacle releasably coupled to said body;

(d) a channel, said channel extending between said first and second ends of said body, said channel recessed from said outer surface of said body toward said cavity, said channel including opposing side walls, said channel including a generally planar inner surface; and (e) a release port, said release port extending between said inner surface of said channel and said cavity.

19. An apparatus as recited in claim 18, further comprising:

(a) an extension pole, said extension pole having first and second ends, said first end of said extension pole coupled to said second end of said body, said extension pole including a hollow chamber, said channel communicating with said chamber; and (b) power coupling means for coupling said second end of said extension pole to a source of rotary power.

20. An apparatus as recited in claim 19, further comprising a collar, said collar coupled to said extension pole, said collar generally aligned with said first end of said extension pole.

* * * * *